US008544379B2

(12) United States Patent
Paul et al.

(10) Patent No.: US 8,544,379 B2
(45) Date of Patent: Oct. 1, 2013

(54) CYLINDER BLOCK AND METHOD FOR THE PRODUCTION OF A CYLINDER BLOCK

(75) Inventors: Michael Paul, Weissach (DE); Frank Ickinger, Pleidelsheim (DE)

(73) Assignee: Dr. Ing. H.C. F. Porsche Aktiengesellschaft (DE)

( * ) Notice: Subject to any disclaimer, the term of this patent is extended or adjusted under 35 U.S.C. 154(b) by 786 days.

(21) Appl. No.: 12/782,779

(22) Filed: May 19, 2010

(65) Prior Publication Data

US 2010/0313746 A1 Dec. 16, 2010

(30) Foreign Application Priority Data

Jun. 10, 2009 (DE) ..... 10 2009 024 463

(51) Int. Cl.
*F02F 1/18* (2006.01)
*C23C 4/12* (2006.01)

(52) U.S. Cl.
USPC ..... 92/169.1; 29/888.06

(58) Field of Classification Search
USPC ..... 92/169.1; 29/888.06, 888.061
See application file for complete search history.

(56) References Cited

U.S. PATENT DOCUMENTS

| | | | | |
|---|---|---|---|---|
| 5,626,674 | A * | 5/1997 | VanKuiken et al. | 29/888.06 |
| 5,909,721 | A | 6/1999 | Ikegaya | |
| 8,252,372 | B2 * | 8/2012 | Terada et al. | 427/233 |

FOREIGN PATENT DOCUMENTS

| | | | |
|---|---|---|---|
| CN | 101418426 | | 4/2009 |
| EP | 2052785 | A1 * | 4/2009 |
| JP | 5631636 | | 8/1954 |
| JP | 06065711 | | 3/1994 |
| JP | 2005179723 | | 7/2005 |
| JP | 2005179723 | A * | 7/2005 |

* cited by examiner

*Primary Examiner* — Thomas E Lazo
(74) *Attorney, Agent, or Firm* — Gerald E. Hespos; Michael J. Porco; Matthew T. Hespos

(57) ABSTRACT

A cylinder block has functional surfaces machined by cutting and with at least one cylinder (5) with a coating. To simplify the production of the cylinder block, the cylinder block (1) has an inwardly projecting collar (25, 26) at the end of the cylinder (5) to delimit the cylinder (5) in the axial direction. The side of the collar (25, 26) facing away the from the cylinder (5) constitutes a stop for a suction extraction device (46) that serves for extracting excess coating material by suction.

6 Claims, 5 Drawing Sheets

CYLINDER BLOCK AND METHOD FOR THE PRODUCTION OF A CYLINDER BLOCK

CROSS-REFERENCE TO RELATED APPLICATION

This application claims priority under 35 USC 119 to German Patent Application No. 10 2009 024 463.8 filed on Jun. 10, 2009, the entire disclosure of which is incorporated herein by reference.

BACKGROUND OF THE INVENTION

1. Field of the Invention

The invention relates to a cylinder block with functional surfaces machined by cutting and with at least one cylinder provided with a coating. The invention relates, further, to a method for producing a cylinder block with at least one cylinder that has a coating.

2. Description of the Related Art

German utility model publication DE 202 00 739 U1 discloses a mask to be placed onto an engine block during the thermal coating of cylinder bores introduced therein. Engine blocks consisting of light metal currently are used to an increased extent in the production of internal combustion engines. However, light metal basically does not have high resistance to abrasion and wear. Thus, the cylinder bores or their walls are provided with a running surface layer. Alternatively, liners are inserted into the cylinder bores and, if appropriate, also may be provided with a running surface layer. The application of such running surface layers mostly takes place by thermal coating methods, and in this context rotating plasmatrons have proved appropriate for applying the layer.

The object of the invention is to simplify the production of a cylinder block.

SUMMARY OF THE INVENTION

The invention relates to a cylinder block with functional surfaces machined by cutting and with at least one cylinder. The cylinder block preferably is a cylinder crankcase with a crankcase upper part and preferably has a plurality of cylinders or cylinder bores. In this regard, a cylinder is defined as a cylindrical space that cooperates with a piston to form a combustion space of an internal combustion engine. The cylinder also functions to guide the piston and preferably is formed as a cylinder bore. The cylinder or its wall also is designated as a running surface for the piston in view of the guiding function of the cylinder or the cylinder wall. The running surface also may be provided on a liner that is inserted into the cylinder or into the cylinder bore. The functional surfaces or the cylinder are machined by cutting, for example by lathe turning, milling, drilling, grinding, honing or lapping. The cylinder or the running surface is provided with a coating comprising an especially wear-resistant coating material. The coating material preferably is applied by a thermal coating method.

The cylinder block has an inwardly projecting collar at the end of the cylinder or at the end of a cylinder bore in the axial direction. The inwardly projecting collar delimits the cylinder. The side of the inwardly projecting collar facing away from the cylinder constitutes a stop for a suction extraction device that extracts excess coating material by suction. The suction extraction device preferably comprises a suction extraction pipe with a free end that is brought to bear against the collar so that the suction extraction pipe covers or shields the space on that side of the collar that faces away from the cylinder, inside the cylinder block, so that this space is not wetted by or does not come into contact with coating material when the cylinder is being coated. The suction extraction device that abuts against the collar can, in a simple way, extract by suction the coating material on the collar side facing away from the cylinder.

The collar preferably is present only in an intermediate machining state for the coating operation. The collar is not required after the coating operation and can be removed again.

The cylinder block preferably is machined by cutting at the end of the cylinder so that the collar is no longer present after the coating operation. Thus, the functioning of the cylinder block advantageously is not impaired by the collar.

The cylinder block preferably is machined by cutting at the end of the cylinder before coating to generate the inwardly projecting collar. The collar deliberately is generated or left standing during cutting machining before the coating operation. Cutting machining may take place, for example, by lathe turning, milling, drilling, grinding, lapping or honing.

The cylinder block preferably is machined by honing cutting at the end of the cylinder before coating to generate the inwardly projecting collar. The term "honing" means stripping. In manufacturing technology, honing is understood to mean a method for the fine cutting machining of metal surfaces with the aid of fine-grained grinding bodies that also are designated as honing stones. Long-stroke honing preferably is employed for machining cylindrical bores.

The inwardly projecting collar preferably is formed as a honing run-out. The honing run-out deliberately is configured, during honing to generate the inwardly projecting collar.

The invention also relates to a method for producing a cylinder block, such as the above-described cylinder block, with functional surfaces machined by cutting and with at least one cylinder with a coating. The cylinder block preferably is a cylinder crankcase with a crankcase upper part and a plurality of cylinders. As noted above, a cylinder is defined as a cylindrical space, which together with a piston, forms a combustion space of an internal combustion engine. The cylinder also functions to guide the piston. The cylinder preferably is a cylinder bore. The cylinder or the cylinder wall also is designated as a running surface of the piston due to the guiding function of the cylinder and the cylinder wall. The running surface also may be provided on a liner that is inserted into the cylinder or into the cylinder bore. The functional surfaces or the cylinder are machined by cutting, for example by lathe turning, milling, drilling, grinding, honing or lapping. The cylinder or the running surface is provided with a coating that comprises or consists of a particularly wear-resistant coating material. The coating material preferably is applied by a thermal coating method.

the method includes machining the cylinder block by cutting at the end of the cylinder before coating to generate an inwardly projecting collar that delimits the cylinder in the axial direction. The side of the collar facing away from the cylinder constitutes a stop for a suction extraction device that functions to extract excess coating material by suction. The suction extraction device preferably comprises a suction extraction pipe with a free end that is brought to bear against the collar so that the suction extraction pipe covers or shields the space on the side of the collar that faces away from the cylinder inside the cylinder block so that this space is not wetted with coating material or does not come into contact with this during the coating of the cylinder. The abutment of the suction extraction device against the collar enables the coating material to be extracted by suction in a simple way on the collar side facing away from the cylinder.

The method preferably comprises machining the cylinder block by honing cutting at the end of the cylinder before coating to generate the inwardly projecting collar. The term "honing" means stripping. In manufacturing technology, honing is understood to mean a method for the fine cutting machine of metal surfaces with the aid of fine-grained grinding bodies that also are designated as honing stones. Long-stroke honing preferably is employed to machine the cylindrical bores.

The method preferably generates the inwardly projecting collar during honing, as a honing run-out. The honing run-out deliberately is configured during honing to generate the inwardly projecting collar.

The method preferably comprises bringing a suction extraction device to bear on the side of the collar that faces away from the cylinder before, during and/or after coating. The suction extraction device preferably is designed as a suction extraction pipe with a free end that is brought to bear against the collar so that the suction extraction pipe covers or shields the inner space of the cylinder block on that side of the collar that faces away from the cylinder, so that this space is not wetted by coating material or does not come into contact with this during coating. The method may include directly extracting excess coating material by suction, preferably during coating, with the aid of the suction extraction device.

The method preferably comprises machining the cylinder block by cutting at the end of the cylinder after coating to remove the collar. The method may include removing the collar directly after coating or removing the collar only after further machining steps have been carried out.

The method may comprise machining the cylinder block by honing cutting at the end of the cylinder after coating to remove the collar. The quality of the running surface for the piston can be improved further as a result of the final honing of the coated running surface of the cylinder.

Further advantages, features and particulars of the invention may be gathered from the following description which describes various exemplary embodiments in detail, with reference to the drawings.

DETAILED DESCRIPTION OF THE PREFERRED EMBODIMENT

Figure 1:
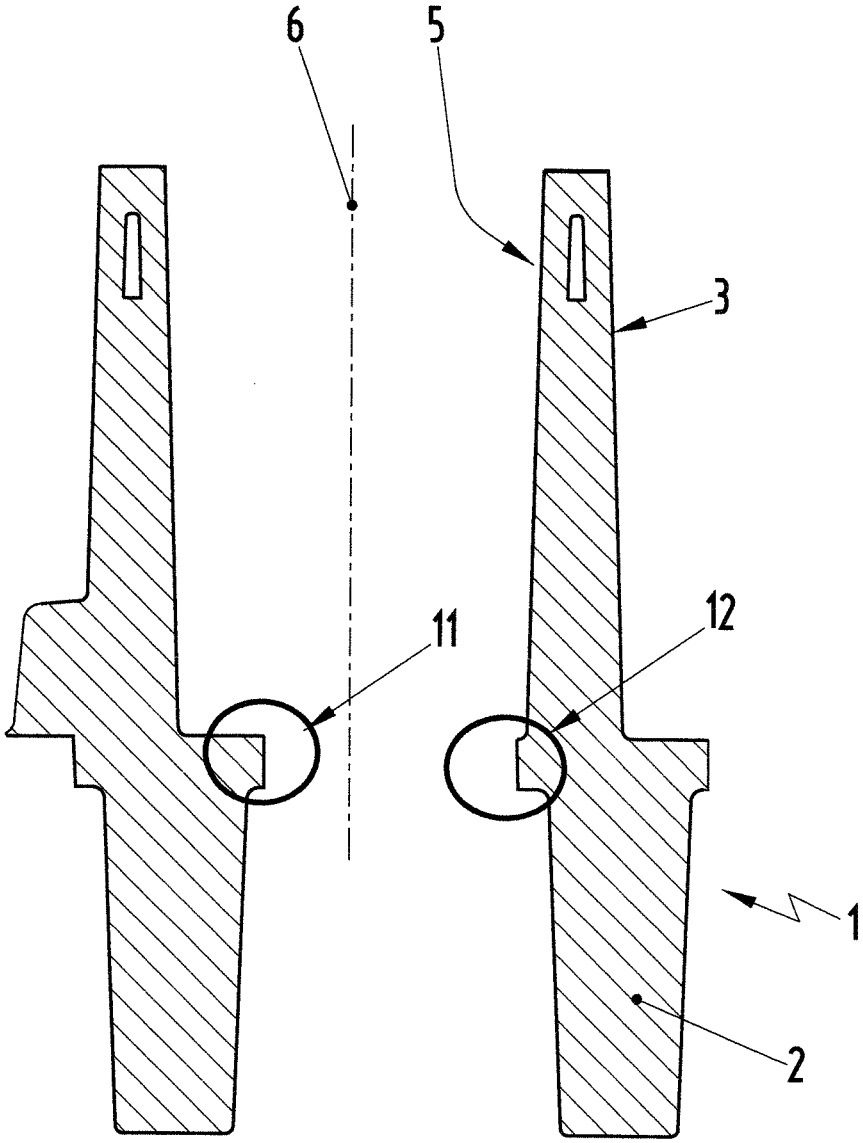
FIG. 1 shows a cylinder block unmachined part in longitudinal section through a cylinder.

FIGS. 1 to 5 illustrate a cylinder block 1 in various machining states. The cylinder block 1 is a cylinder crankcase with a crankcase upper part 2 and with a cylinder block 3. The cylinder block 3 comprises a plurality of cylinders, of which only one cylinder 5 with a mid-axis 6 can be seen in the longitudinal section illustrated.

The cylinder block 1 is produced, for example, from light metal or from cast iron by casting. If the cylinder block 1 is produced from cast iron with graphite flakes, the cylinder runways also mostly are formed by the cast iron of the cylinder block due to the good sliding and wearing properties. Cylinder blocks consisting of light metal, such as aluminum and alloys, may use cylinder liners or the sliding and wearing properties of the cylinder runway may be improved by special machining methods, such as coating. Cylinder runways consisting of cast iron also may be coated.

FIG. 1 illustrates the cylinder block 1 as unmachined part after the casting process with casting slopes. A build-up of material is indicated at two points 11 and 12 at the end of the cylinder 5 inside the cylinder block 3. The material build-up 11, 12 running around radially on the inside is deliberately generated during casting and is modified in further machining steps, as explained below.

Figure 2:
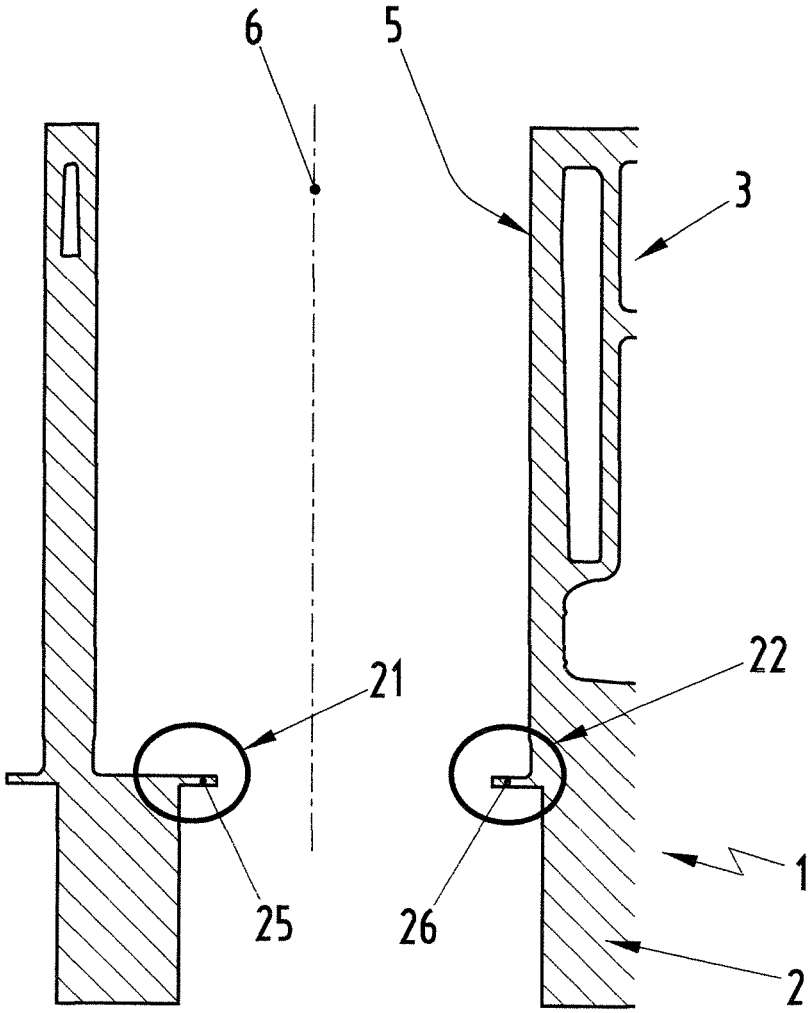
FIG. 2 shows the cylinder block from FIG. 1 in an intermediate machine state with a flat honing run-out.

FIG. 2 illustrates the cylinder block 1 from FIG. 1 after cutting machining by honing. Honing machines the cylinder 5 by cutting so that casting slopes are removed and the cylinder 5 becomes a straight circular cylinder. A collar 25, 26 is generated by a flat honing run-out 21, 22 and projects radially in at the end of the cylinder 5 to delimit the cylinder 5 in the axial direction, which is parallel to the mid-axis 6 of the cylinder 5.

Figure 3:
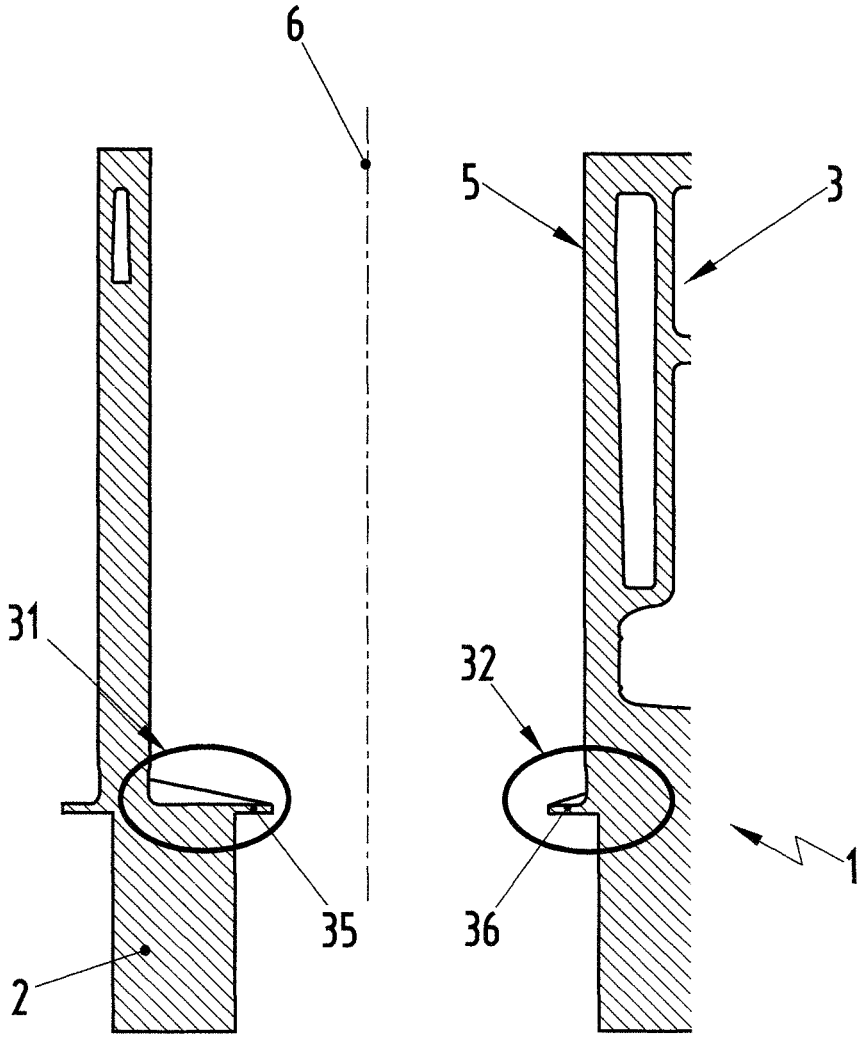
FIG. 3 shows the cylinder block from FIG. 1 in an intermediate machining state with an oblique honing run-out.

FIG. 3 indicates that, during the honing of the cylinder 5, a radially inwardly projecting collar 35, 36 also can be generated with the aid of an oblique honing run-out 31, 32. The collar 35, 36 has the same function as in the exemplary embodiment illustrated in FIG. 2.

Figure 4:
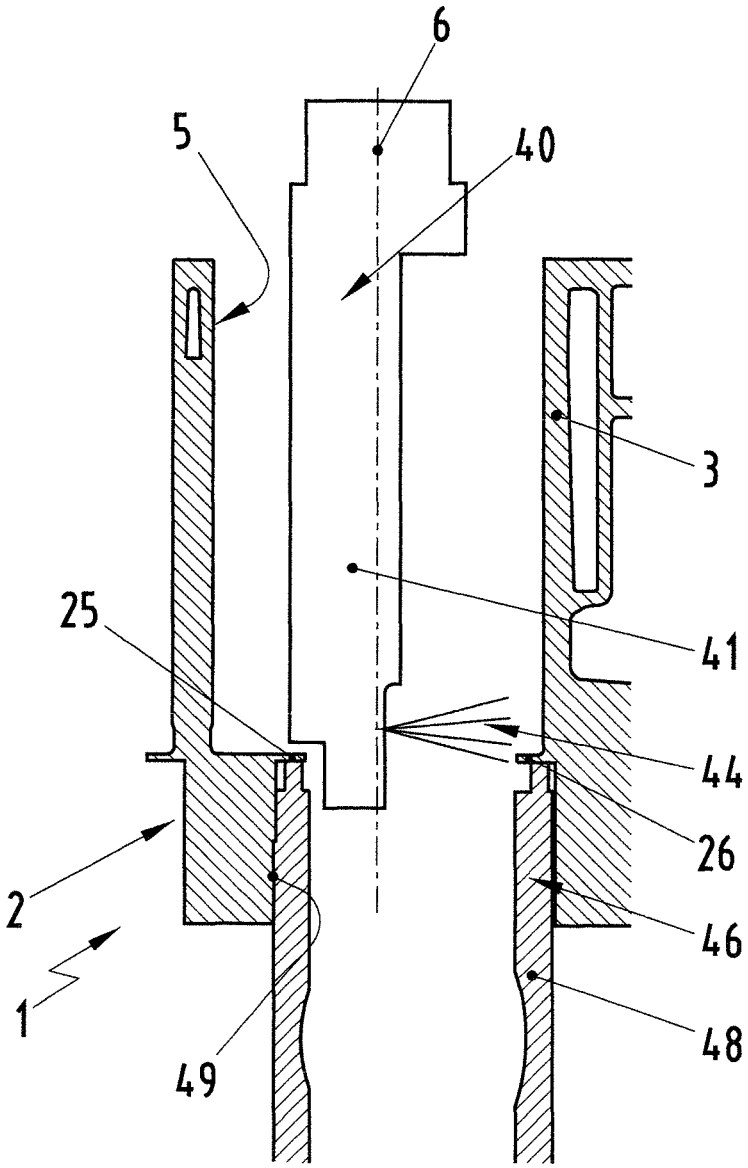
FIG. 4 shows the cylinder block from FIG. 2 during the application of a coating.

FIG. 4 illustrates the purpose served by the collar 25, 26 in FIG. 2 or the collar 35, 36 in FIG. 3, which is generated during honing. More particularly, a coating device 40 is used to provide a coating on the cylinder 5 or the running surface of the cylinder 5 after the cutting machining by honing indicated in FIGS. 2 and 3. The coating device 40 comprises, for example, a spray lance 41 that applies a coating material 44 is applied to the running surface of the cylinder 5. The coating material 44 also is designated as a spray.

Excess coating material is extracted by suction with the aid of a suction extraction device 46. The suction extraction device 46 comprises a suction extraction pipe 48 with a free end that is in sealing bearing contact with and/or in abutment against the collar 25, 26. The suction extraction pipe 48 is arranged radially within an inner wall 49 of the crankcase upper part 2. The sealing contact of the suction extraction pipe 49 with the collar 25, 26 ensures that no coating material passes onto the inner wall 49 of the crankcase upper part 2 during the coating of the running surface of the cylinder 5.

Figure 5:
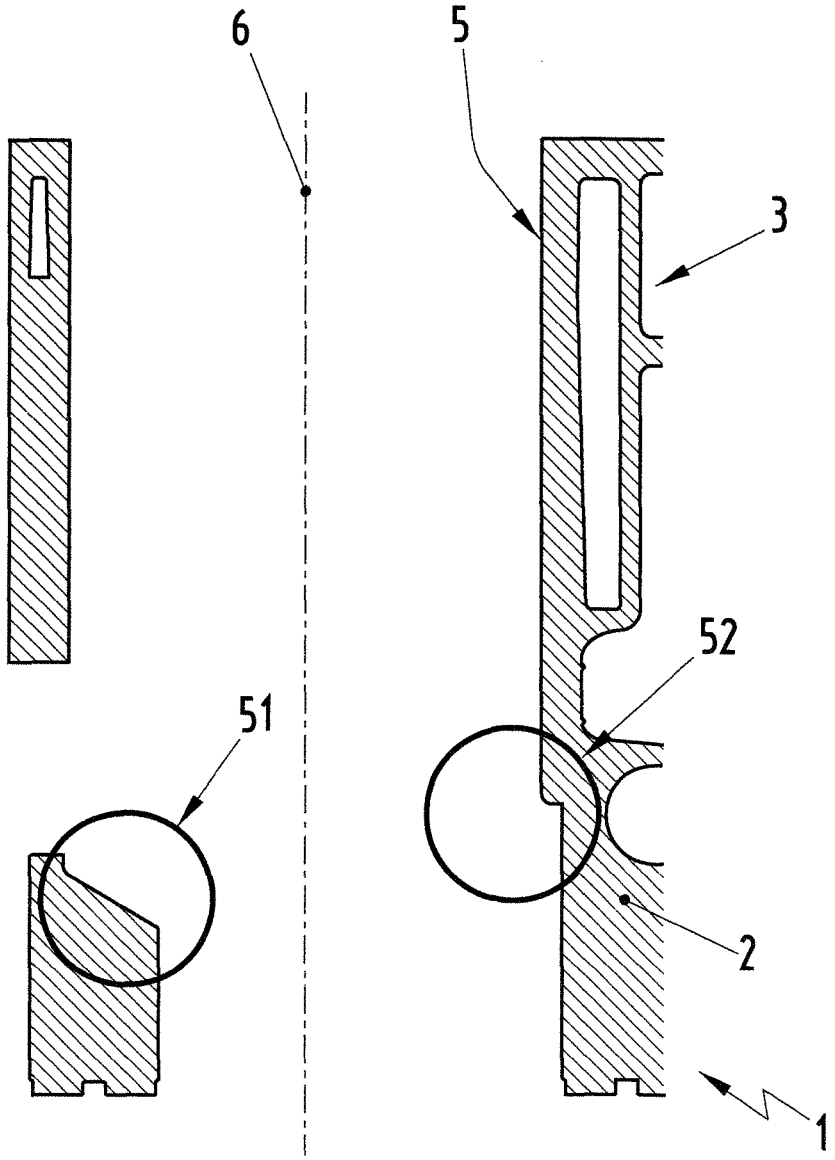
FIG. 5 shows the cylinder block from FIG. 4 in the ready-machined state.

FIG. 5 illustrates the cylinder block 1 after coating and after further cutting machining by honing. The collar designated by 25, 26 in FIG. 2 and by 35, 36 in FIG. 3 is removed by final honing machining. The final honing machining may be carried out by means of an oblique high run-out 51 or by means of a flat high run-out 52. After coating, the collar no longer has any function and is removed in a simple way by the finish machining of the cylinder block 1.

What is claimed is:

1. A method for producing a cylinder block comprising:

casting a block to define at least one cylinder with casting slopes;

machining the block by cutting to remove the casting slopes and to form functional surfaces while leaving an inwardly projecting collar at an end of the cylinder to delimit the cylinder in an axial direction, the inwardly projecting collar having a surface facing away from the cylinder;

placing a suction extracting device in sealing engagement with the surface of the inwardly projecting collar facing away from the cylinder;

applying a coating to the functional surfaces of the cylinder;

applying suction with the suction extraction device at least during coating for extracting excess coating material by suction; and removing the inwardly projecting collar after coating.

2. The method of claim 1, wherein the step of machining is carried out by honing cutting at the end of the cylinder before coating to generate the inwardly projecting collar.

3. The method of claim 2, wherein the inwardly projecting collar is generated, during honing, as a honing run-out.

4. The method of claim 1, wherein the step of removing the inwardly projecting collar after coating comprises machining the cylinder block by cutting after coating to remove the collar.

5. The method of claim 4, wherein the cylinder block is machined by honing cutting at the end of the cylinder after coating to remove the collar.

6. The method of claim 1, wherein the step of placing a suction extracting device in sealing engagement with the surface of the inwardly projecting collar facing away from the cylinder comprises abutting the suction extraction device against the surface of the inwardly projecting collar facing away from the cylinder without having the suction extraction device extend into the cylinder.

* * * * *